US006362569B1

(12) United States Patent
Wijenberg et al.

(10) Patent No.: US 6,362,569 B1
(45) **Date of Patent: *Mar. 26, 2002**

(54) HIGH-PRESSURE METAL HALIDE DISCHARGE LAMP

(75) Inventors: Christoffel Wijenberg; Peter A. Seinen; Joseph L. G. Suijker, all of Eindhoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/064,206

(22) Filed: Apr. 22, 1998

(30) Foreign Application Priority Data

Apr. 25, 1997 (EP) ..... 97201242

(51) Int. Cl.[7] ..... H01J 17/16; H01J 61/30

(52) U.S. Cl. ..... 313/634; 313/637; 313/640; 313/641; 313/639

(58) Field of Search ..... 313/571, 573, 313/634, 567, 620

(56) References Cited

U.S. PATENT DOCUMENTS

| | | | | | |
|---|---|---|---|---|---|
| 3,911,308 | A | * | 10/1975 | Akutsu et al. | 313/573 |
| 4,468,590 | A | * | 8/1984 | Akutsu et al. | 313/573 |
| 4,626,743 | A | * | 12/1986 | Vida | 313/571 |
| 4,910,432 | A | | 3/1990 | Brown et al. | 313/620 |
| 5,075,587 | A | | 12/1991 | Pabst et al. | 313/25 |
| 5,097,176 | A | * | 3/1992 | De Hair et al. | 313/573 |
| 5,363,007 | A | * | 11/1994 | Fromm et al. | 313/571 |
| 5,424,609 | A | | 6/1995 | Geven et al. | 313/623 |
| 5,589,735 | A | * | 12/1996 | Yamaguchi et al. | 313/573 |
| 5,714,839 | A | * | 2/1998 | Chao | 313/571 |
| 5,936,351 | A | * | 8/1999 | Lang | 313/571 |

FOREIGN PATENT DOCUMENTS

| | | | |
|---|---|---|---|
| EP | 0215524 | 3/1987 | H01J/61/30 |

* cited by examiner

*Primary Examiner*—Nimeshkumar D. Patel
*Assistant Examiner*—Mariceli Santiago

(57) ABSTRACT

A high-pressure metal halide discharge lamp having a power rating of at most 100 W is provided with a discharge vessel having a translucent ceramic wall with a thickness d of at least 1.2 mm. In the discharge space enclosed thereby, two electrodes are arranged with their electrode tips at a mutual interspacing EA. The discharge vessel contains an ionizable filling comprising at least Na and a halide.

8 Claims, 1 Drawing Sheet

HIGH-PRESSURE METAL HALIDE DISCHARGE LAMP

BACKGROUND OF THE INVENTION

The invention relates to a high-pressure metal halide discharge lamp with a power rating of at most 100 W, provided with a discharge vessel having a translucent ceramic wall with a thickness d, which discharge vessel encloses a discharge space in which two electrodes, each provided with an electrode tip, are arranged with the electrode tips at a mutual distance EA, which discharge vessel contains an ionizable filling including a halide of sodium, and which discharge vessel is cylindrical over the distance EA and has an internal cross-sectional diameter Di.

A lamp of the kind mentioned in the opening paragraph is known from EP 215524. The known lamp, which has a power rating of 40 W, has a discharge vessel wall thickness of 0.45 mm. The ionizable filling of the discharge vessel comprises besides Hg also halides of Na, Tl, and In. The lamp has good color properties, in particular a good color point with coordinates (x;y), and good values both for the general color rendering index Ra and for the color rendering index $R_9$ designating the rendering of red. This renders the lamp basically highly suitable for interior lighting applications. In this lamp that a good color rendering is possible when Na halide is used as a filling ingredient of a lamp, and the Na pressure is so high during operation that a strong widening and inversion of the Na emission in the Na-D lines takes place. Since the Na is present in excess quantity, this requires a high temperature of the coldest spot $T_{cs}$ in the lamp vessel of, for example, 1000 K (730° C.) during lamp operation. The Na-D lines assume the shape of an emission band in the spectrum with two maxima having a mutual interspacing $\Delta\lambda$ in the case of inversion and widening of these lines. The requirement that $T_{cs}$ should have a high value excludes under practical conditions the use of quartz or quartz glass for the discharge vessel wall and necessitates the use of a ceramic material.

The term "ceramic wall" in the present description and claims is understood to mean both a gastight wall of metal oxide such as, for example, sapphire or densely sintered polycrystalline $Al_2O_3$, and a wall made of metal nitride, for example AlN.

A disadvantage of the known lamp is that the lamp has a comparatively short life in practice owing to attacks on and cracking of the discharge vessel.

SUMMARY OF THE INVENTION

The invention has for its object to provide a measure for realizing a lamp having a longer useful life. For this purpose the thickness d of the wall is at least 1.2 mm.

The use of a comparatively thick wall advantageously leads not only to a better heat transport from the portion of the wall between the electrodes to the comparatively cool ends of the discharge vessel, but most of all to an increase in heat radiation emitted by the wall of the discharge vessel. Compared with a wall according to the prior art, the thick wall here leads to a lower wall temperature as well as to a smaller temperature gradient across the wall. The latter has a particularly favorable influence on a reduction of chemical processes in which the transport of components plays a major role. It is true that the thicker wall in itself leads to a reduced attack and a smaller risk of fractures, but on the other hand it results in a reduction of the temperature of the coldest spot $T_{cs}$, all other parameters remaining the same. It is found in the known lamp that the color properties, in particular the color point and the general color rendering index, are highly sensitive to changes in $T_{cs}$.

A reduction in this sensitivity to changes in $T_{cs}$ is achieved to a high degree when the ionizable filling is free from In. A further improvement can be achieved in that the ionizable filling comprises a rare earth halide. A strongly improved color stability throughout lamp life is also realized thereby. Dy was found to be a particularly suitable ingredient for the ionizable filling in this respect.

Preferably, the relation $0.4 \leqq EA/Di \leqq 1.5$ is complied with in a lamp according to the invention. The advantage of this is that, in spite of the thick wall, the $T_{cs}$ value lies in a range between 1200 K and 1300 K, while at the same time the maximum temperature of the discharge vessel wall remains limited to 1400 K. It was found in experiments that a value of $\Delta\lambda$ between 12 nm and 60 nm can be realized for a value of $T_{cs}$ in the range from 1200 K to 1300 K. To realize a lamp radiating white light with a general color rendering index of at least 90, it is desirable for the value of $\Delta\lambda$ to lie between 12 nm and 60 nm.

It is found for a ratio $EA/Di \leqq 0.4$ that a considerable blackening of the discharge vessel wall occurs in a comparatively short time owing to convection flows in the lamp vessel. Such a blackening is disastrous for good color properties of the lamp. If the ratio is chosen to be greater than 1.5, on the other hand, it is found in practice that a value of the general color rendering index greater than 90 cannot be combined with a long lamp life without unacceptable loss of luminous efficacy.

DETAILED DESCRIPTION OF THE PREFERRED EMBODIMENTS

Figure 1:
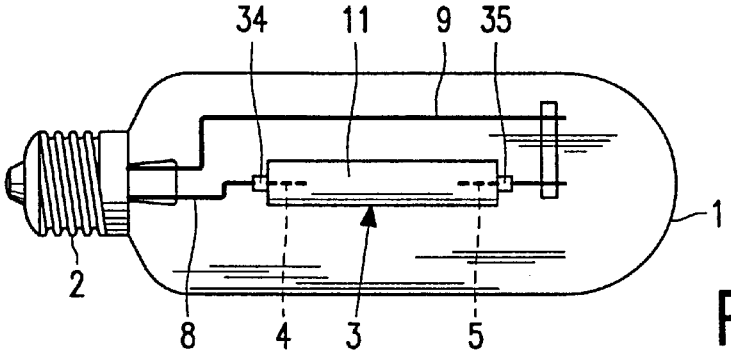
FIG. 1 diagrammatically shows a lamp according to the invention.
Figure 2:
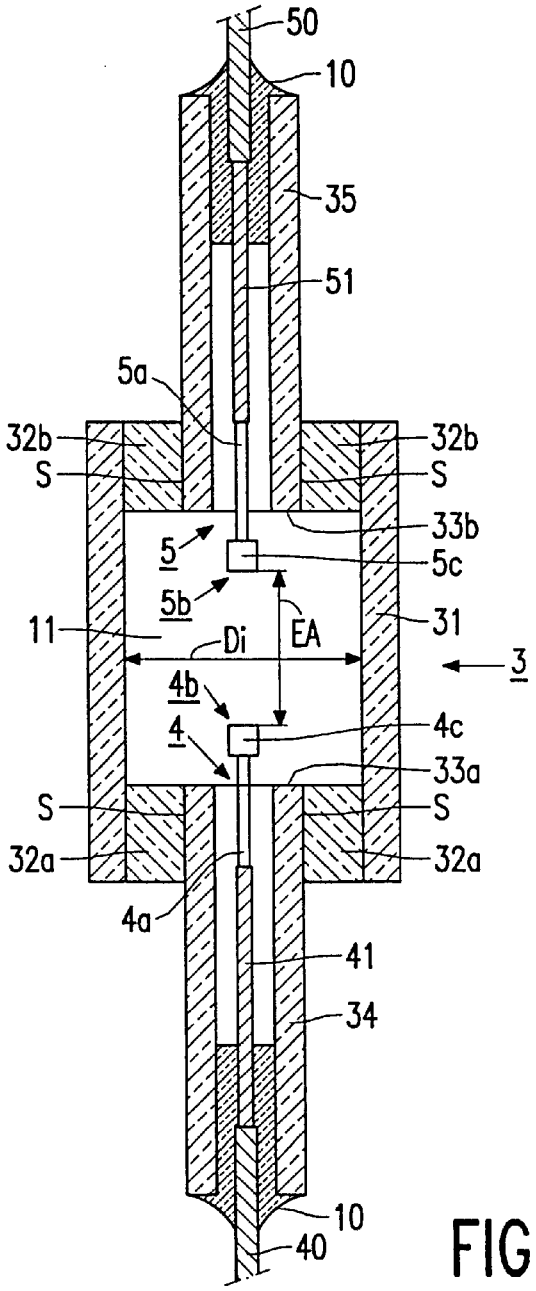
FIG. 2 shows the discharge vessel of the lamp of FIG. 1 in detail.

FIG. 1 shows a metal halide lamp provided with a discharge vessel 3 having a ceramic wall with a thickness d which encloses a discharge space 11 containing an ionizable filling which includes a halide of sodium. Two electrodes are arranged in the discharge space with their tips having a mutual interspacing EA, the discharge vessel being cylindrical at least over the distance EA and having an internal cross-sectional diameter Di. The discharge vessel is closed at one end by means of a ceramic projecting plug 34, 35 which encloses with narrow intervening space a current lead-through conductor (FIG. 2: 40, 41, 50, 51) to an electrode 4, 5 arranged in the discharge vessel, and is connected to this electrode at an end remote from the discharge space by means of a melting-ceramic joint (FIG. 2: 10) in a gastight manner. The discharge vessel is surrounded by an outer bulb 1 which is fitted with a lamp cap 2 at one end. A discharge extends between the electrodes 4 and 5 when the lamp is in the operating state. The electrode 4 is connected via a current conductor 8 to a first electrical contact which forms part of the lamp cap 2. The electrode 5 is connected via a current conductor 9 to a second electrical contact which forms part of the lamp cap 2. The discharge vessel, shown in more detail in FIG. 2 (not true to scale), has a ceramic wall 31 and is formed from a cylindrical part having an internal diameter Di bounded on either side by end wall portions 32*a*, 32*b*, each end wall portion 32*a*, 32*b* defining an end face 33*a*, 33*b* of the discharge space. The end wall portions each have an opening in which a ceramic projecting plug 34, 35 is fastened in the end wall portion 32*a*, 32*b* in a gastight manner by means of a sintered joint S. The ceramic projecting plugs 34, 35 each narrowly enclose a current lead-through conductor 40, 41, 50, 51 of a respective electrode 4, 5 having a tip 4*b*, 5*b*. The current lead-through conductor is connected to the ceramic projecting plug 34, 35 at the side remote from the discharge space by means of a melting-ceramic joint 10 in a gastight manner.

The electrode tips 4*b*, 5*b* are situated at a mutual distance EA. The current lead-through conductors each comprise a respective part 41, 51 which is highly resistant to halides, for example in the form of a Mo-$Al_2O_3$ cermet, and a part 40, 50 which is fastened in a gastight manner to a respective end plug 34, 35 by means of the melting-ceramic joint 10. The melting-ceramic joint extends over some distance, for example approximately 1 mm, over the Mo cermet 41, 51. It is possible for the parts 41, 51 to be formed in a manner other than from a Mo-$Al_2O_3$ cermet. Other possible constructions are known, for example, from EP-0 587 238 (U.S. Pat. No. 5,424,609). A particularly suitable construction was found to be inter alia one comprising a coil highly resistant to halides wound around a similarly resistant pin. Mo is a highly suitable as the material which is highly resistant to halides. The parts 40, 50 are made from a metal having a coefficient of expansion which corresponds closely to that of the end plugs. Nb, for example, is for this purpose a very suitable material. The parts 40, 50 are connected to the current conductors 8, 9, respectively, in a manner not shown in any detail. The lead-through construction described above renders it possible to operate the lamp in any burning position.

Each of the electrodes 4, 5 comprises an electrode rod 4*a*, 5*a*, provided with a coiling 4*c*, 5*c* adjacent the tip 4*b*, 5*b*. The projecting ceramic plugs are fastened in the end wall portions 32*a* and 32*b* in a gastight manner by means of a sintered joint S. The electrode tips here lie between the end faces 33*a*, 33*b* formed by the end wall portions. In an alternative embodiment of a lamp according to the invention, the projecting ceramic plugs 34, 35 are recessed relative to the end wall portions 32*a* and 32*b*. In that case the electrode tips lie substantially in the planes of the end faces 33*a*, 33*b* defined by the end wall portions.

In a practical realization of the lamp according to the invention as shown in the drawing, the rated lamp power is 40 W and the lamp has a rated lamp voltage of 95 V. The translucent wall of the discharge vessel has a thickness of 1.2 mm. The internal diameter Di of the discharge vessel is 4 mm, the interspacing between the electrode tips EA is 4 mm. The ionizable filling of the lamp comprises 3 mg Hg, and 7 mg (Na+Tl+Dy) iodide having a molar composition of 83.6, 7.2, and 9.2%, respectively. The discharge vessel also contains Ar with a filling pressure of 300 mbar to promote starting. The value of $T_{cs}$ is 1265 K during lamp operation. The lamp radiates light with a luminous efficacy of 77 1 m/W after 100 h. The color temperature $T_c$ of the radiated light is 2914 K, and the color point coordinates (x;y) are (0.443;0.406). The general color rendering index Ra is 92, the index $R_9$ is 31, and the value of $\Delta\lambda$ is 12.9 nm. After 1000 hours of operation, the luminous efficacy is 63 lm/W, $T_c$ is 2780 K, Ra is 93, $R_9$ is 40, and (x;y) is (0.454;0.411). After 4500 hours of operation, said quantities have the values 55 lm/W; 2752 K; 93; 38, and (0.455;0.409). After 10,000 hours, the following values are measured for the above quantities: 50 lm/W; 2754 K; 92; 30; and (0.454;0.407). The value of $\Delta\lambda$ has changed only slightly during this, rising to 13.3 nm. After 14,000 hours of operation, the discharge vessel showed no fractures or leaks owing to attacks on the discharge vessel wall. A comparable lamp having a wall thickness d of its discharge vessel of 0.9 mm reached the end of its life after 2500 hours already owing to leaks of the discharge vessel. A similar lamp, but with a wall thickness of 0.6 mm, had a leaky discharge vessel after as few as 2000 hours of operation. In a comparable lamp whose ionizable filling contains In instead of a rare earth halide, the color point varied over a period of 2000 burning hours from an initial (0.429;0.417) to (0.467;0.422). The Ra value was only 80, and $R_9<0$.

A wall thickness of 1.6 mm or more does achieve a long lamp life (14,000 hours), but it results in a low value for $T_{cs}$(<1200 K) which is relatively so low that the general color rendering index Ra at the start of lamp life has a value below 90. Such a low value of $T_{cs}$ also gives rise to a comparatively wide drift of the color point during lamp life.

In a further practical realization of a lamp according to the invention as shown in the drawing, the rated lamp power again is 40 W. The internal diameter Di of the discharge vessel, however, is 5 mm and the electrode tip interspacing EA is 3 mm. The thickness of the translucent wall of the discharge vessel and the metal halide filling thereof are the same as in the previous embodiment. The following photometric quantities were measured for the lamp, which was operated on a self-inductance ballast:

| | |
|---|---|
| color temperature $T_c$ | 2740K |
| general color rendering index Ra | 93 |
| color rendering index $R_9$ | 79 |
| color point | (0.449; 0.397) |
| luminous efficacy | 68 lm/W |
| $\Delta\lambda$ | 19.6 nm |

In another practical realization, lamps having a power rating of 70 W were manufactured. The internal diameter Di is 6 mm in a first lamp, and the electrode tip spacing EA is 4 mm. After 100 and 3700 hours of operation, the color temperature values $T_c$ are 2980 K and 2905 K, respectively, the color point co-ordinates (0.435;0.398) and (0.441;0.401), respectively, the general color rendering index Ra is 96 at both moments, and the color rendering index $R_9$ is 80 and 81, respectively. The luminous efficacy values at said moments are 80 lm/W and 60 lm/W, respectively.

In a second lamp, the EA value is increased to 5 mm compared with the first lamp. The values measured after 100 hours of operation are: $T_c$ 2908 K, (x;y) (0.442;0.403); Ra 93; $R_9$ 40, and luminous efficacy 83 lm/W. The values of the same quantities are: 2837 K; (0.447;0.403) 93; 42; and 67 lm/W after 3700 hours of operation.

What is claimed is:

1. A high-pressure metal halide discharge lamp with a power rating of at most 100 W, provided with a discharge vessel having a translucent ceramic wall with a thickness d, which discharge vessel encloses a discharge space in which two electrodes, each provided with an electrode tip, are arranged with said electrode tips at a mutual distance EA, which discharge vessel contains an ionizable filling comprising Hg and a halide of sodium, and which discharge vessel is cylindrical over said distance EA and has an internal cross-sectional diameter Di, characterized in that the thickness d of the wall is at least 1.2 mm and the discharge vessel complies with the relation $0.4 \leqq EA/Di \leqq 1.5$.

2. A lamp as claimed in claim 1, characterized in that the ionizable filling is free from In.

3. A lamp as claimed in claim 1 wherein the ionizable filling comprises a rare earth halide.

4. A lamp as in claim 3 wherein the rare earth halide comprises dysprosium iodide.

5. A lamp as in claim 4 wherein the filling further comprises thallium iodide.

6. A lamp as in claim 5 wherein said halide of sodium is sodium iodide.

7. A lamp as in claim 1 wherein $0.4 \leqq EA/Di \leqq 1.0$.

8. A lamp as in claim 1 wherein said halide of sodium is sodium iodide.

* * * * *